US011035225B2

(12) United States Patent
Oon et al.

(10) Patent No.: US 11,035,225 B2
(45) Date of Patent: Jun. 15, 2021

(54) HYDRAULIC POSITIONING CONTROL FOR DOWNHOLE TOOLS

(71) Applicant: HALLIBURTON ENERGY SERVICES, INC., Houston, TX (US)

(72) Inventors: Peng Hooi Oon, Singapore (SG); Kai Zyn Teo, Singapore (SG); Himanshu Gupta, Singapore (SG); Wei Leong Wong, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 461 days.

(21) Appl. No.: 15/889,994

(22) Filed: Feb. 6, 2018

(65) Prior Publication Data

US 2019/0242248 A1 Aug. 8, 2019

(51) Int. Cl.

| | |
|---|---|
| ***E21B 44/00*** | (2006.01) |
| ***E21B 47/135*** | (2012.01) |
| ***E21B 44/06*** | (2006.01) |
| ***E21B 47/01*** | (2012.01) |
| ***E21B 23/04*** | (2006.01) |

(Continued)

(52) U.S. Cl.

CPC ..... *E21B 47/135* (2020.05); *E21B 23/04* (2013.01); *E21B 44/005* (2013.01); *E21B 44/06* (2013.01); *E21B 47/01* (2013.01); *E21B 47/024* (2013.01); *E21B 47/092* (2020.05)

(58) Field of Classification Search

CPC ..... E21B 44/005; E21B 47/01; E21B 47/02
See application file for complete search history.

(56) References Cited

U.S. PATENT DOCUMENTS 4,406,332 A * 9/1983 Dismukes ..... E21B 4/00 15/104.12
5,368,108 A * 11/1994 Aldred ..... E21B 44/005 175/40

(Continued)

FOREIGN PATENT DOCUMENTS

CA 2271525 A1 * 11/1999 ..... E21B 44/06

OTHER PUBLICATIONS

Halliburton , "AGS Adjustable Gauge Stabilizer", retrieved from the internet at http://www.halliburton.com/en-US/ps/sperry/drilling/downhole-tools/ags-adjustable-gauge-stabilizer-tool.page on Feb. 2, 2018, 1 page.

*Primary Examiner* — Andrew M Tecco
*Assistant Examiner* — Eyamindae C Jallow
(74) *Attorney, Agent, or Firm* — Kilpatirck Townsend & Stockton LLP

(57) ABSTRACT

A downhole tool, such as a logging-while-drilling tool, includes hydraulics that can provide real-time, automated control of the position of the downhole tool relative to a formation face. The positioning of the downhole tool is accomplished using processor-control of the hydraulics and using fluid present within the downhole tool, for example, mud from the downhole tool's mud bore. During operation the processor receives a signal that is indicative of the distance between the tool and a formation wall in the wellbore. The processor uses this information to position the downhole tool relative to the formation face by controlled injection of fluid into the annulus around the downhole tool. The reaction force from the pressure acts against the tool and pushes the downhole tool towards the opposite side where the annular pressure is lower.

20 Claims, 6 Drawing Sheets

(51) Int. Cl.
*E21B 47/024* (2006.01)
*E21B 47/092* (2012.01)

(56) References Cited

U.S. PATENT DOCUMENTS

| | | | | |
|---|---|---|---|---|
| 5,603,386 | A * | 2/1997 | Webster | E21B 7/062 175/76 |
| 6,092,610 | A * | 7/2000 | Kosmala | E21B 4/20 175/61 |
| 6,206,108 | B1 * | 3/2001 | MacDonald | E21B 49/005 175/24 |
| 6,601,652 | B1 * | 8/2003 | Moore | E21B 23/08 166/381 |
| 8,024,868 | B2 | 9/2011 | Brannigan et al. | |
| 8,162,076 | B2 | 4/2012 | Martinez et al. | |
| 9,506,335 | B1 * | 11/2016 | Smith | E21B 44/005 |
| 2009/0070041 | A1 | 3/2009 | Ramos et al. | |
| 2009/0242317 | A1 | 10/2009 | Tashiro et al. | |
| 2013/0341095 | A1 * | 12/2013 | Perrin | E21B 7/062 175/45 |
| 2015/0000977 | A1 * | 1/2015 | Wang | E21B 47/00 175/40 |
| 2015/0101800 | A1 * | 4/2015 | Chang | G01V 1/523 166/250.01 |
| 2015/0107899 | A1 * | 4/2015 | Fisher, Jr. | E21B 49/003 175/27 |
| 2016/0024848 | A1 * | 1/2016 | Desmette | E21B 7/067 175/74 |

* cited by examiner

HYDRAULIC POSITIONING CONTROL FOR DOWNHOLE TOOLS

TECHNICAL FIELD

The present disclosure relates generally to devices for use in well systems. More specifically, but not by way of limitation, this disclosure relates to real-time, automated control of the position of a downhole tool to maintain an appropriate stand-off gap between the downhole tool and the formation wall.

BACKGROUND

Downhole measurement tools are often deployed by wirelines. Instead of wireline deployment, measurement tools are alternatively sometimes coupled to or integrated with the drill string, which avoids the extra cost associated with removing the drill string prior to measurement. Logging-while-drilling ("LWD"), uses certain tools deployable downhole (i.e., downhole tools), such as coupled to or integrated with the drill string to determine formation properties such as permeability, porosity, resistivity, and other properties. In some cases, the information obtained by LWD allows operators to make real-time decisions and changes to ongoing drilling operations.

DETAILED DESCRIPTION

Figure 1:
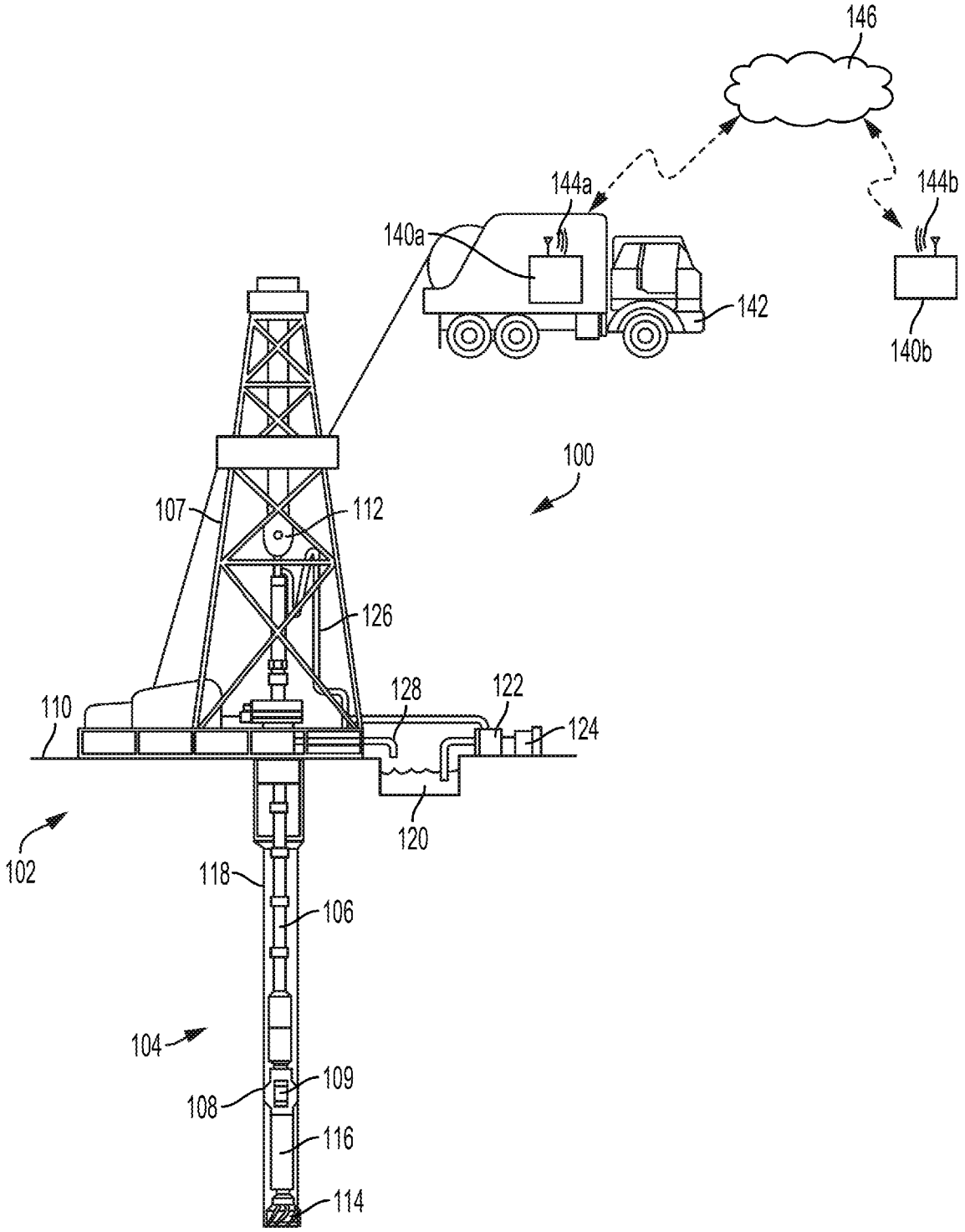
FIG. 1 is a cross-sectional view of an example of a well system that includes a downhole tool according to some aspects.

Certain aspects and features of the present disclosure include real-time, automated control of the position of a downhole tool relative to a formation face. The positioning of the downhole tool is accomplished using processor-controlled hydraulics and fluid present within the tool, such as mud from the downhole tool's mud bore.

Certain aspects and features further include providing a downhole tool with hydraulics to position the tool, for example, to deviate the position of the tool while downhole, such as in an elliptical or washout borehole. This technique can be used, for example, where the gap between a tool detector and the formation face needs to be minimized or kept within an optimal range in order to achieve accuracy of readings taken by the detector. The technique can prevent the quality of readings from degrading as the stand-off distance increases, reducing or eliminating the need for correction of measurement error as would be needed for some types of detectors. A gamma-ray density tool is an example of an LWD tool that would suffer from this problem.

A hydraulic package within the downhole tool creates differential pressure laterally across the tool to create a net lateral force tending to move the tool nearer to the borehole wall at one location and correspondingly away from the borehole wall at an opposite location. The hydraulic package may be specifically configured so that a measurement end of the tool or, more specifically, a detector of the tool, is at the location moved nearer to the borehole wall. In one implementation, drilling mud is diverted from the fluid bore within the tool and flows into at least one flow line, which may pass through a hydraulic pump to increase the level of pressure and inject the mud into the annulus around the tool through an orifice. The detector may be located generally opposite the orifice. As the mud is injected into the annulus, the reaction force from the mud pressure acts against the tool to move the measurement end of the tool opposite the orifice closer to the borehole wall, where the annular pressure is lower. Moving the detector closer to the formation wall achieves a reduced standoff distance to improve accuracy of readings taken using the detector. This innovative tool and method is a robust solution, and may further provide a damping effect due to the fluid itself serving to cushion the tool and reduce operating loads such as impact and vibration.

In some examples, a downhole tool includes a housing defining a fluid bore and a sensor responsive to a distance between the downhole tool and a formation wall of an annulus of a wellbore (generally referred to herein as a position sensor). The position sensor can be dedicated to this purpose or be part of a detector or other functionality in the downhole tool. A hydraulic package is in communication with the position sensor and in fluid communication with the fluid bore. The hydraulic package includes at least one hydraulic valve. The hydraulic package is operable to adjust fluid flow responsive, at least in part, to signal output of the position sensor, to thereby control and/or vary a distance between the detector and the formation wall. For example, in one implementation, a processor included with or in communication with the position sensor and the hydraulic package may execute control logic to control the hydraulic package and maintain a specified value or stay within a pre-defined range of values for the distance by selectively diverting fluid from the fluid bore to the annulus based on the signal from the position sensor.

In some examples, the downhole tool includes a processor connected to the hydraulic package and the position sensor. The processor in such an example controls the hydraulic package, by implementing special-purpose control logic specific to the described downhole tool, such as by controlling fluid flow to affect the corresponding tool position, at least in part in response to signals from the position sensor. In other examples, the downhole tool includes a connection for a computing system to be located remotely from the downhole tool, such as at the surface of a wellbore, and the processor in the remotely located computing system controls the hydraulic package at least in part in response to signals from the position sensor. The hydraulic package includes at least one source of hydraulic fluid pressure such as a hydraulic pump connected between the fluid bore and an orifice, and at least one hydraulic valve. A downhole tool can optionally include multiple hydraulic packages angularly distributed around the tool collar in order to provide enhanced positioning control.

In some examples, in order to provide a wide range of hydraulic force to account for different types of tools and different downhole conditions and arrangements, the processor may instruct the hydraulic package to route the fluid through the hydraulic pump between the fluid bore and the orifice when more force is required to maintain the operating distance between the formation wall and the downhole tool within a selected range. When less force is needed, the processor may, for example, instruct the hydraulic package to route the fluid to a flow line with no hydraulic pump to maintain the operating distance between the formation wall and the detector within the selected range using the fluid pressure alone.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view of an example of a drilling system 100 that may employ one or more principles of the present disclosure. A wellbore may be created by drilling into the formation 102 using the drilling system 100. The drilling system 100 may be configured to drive a bottom hole assembly (BHA) 104 positioned or otherwise arranged at the bottom of a drillstring 106 extended into the formation 102 from a derrick 107 arranged at the surface 110. The derrick 107 includes a kelly 112 used to lower and raise the drillstring 106. The BHA 104 may include a drill bit 114 operatively coupled to a tool string 116, which may be moved axially within a drilled wellbore 118 as attached to the drillstring 106. Tool string 116 may include LWD downhole tool 108 that uses one or more detectors 109 to determine conditions of the wellbore and formation, and return values for various parameters to the surface through cabling (not shown) or by wireless signal. LWD downhole tool 108 includes a hydraulic package for positioning the tool relative to the formation face in the wellbore as described herein. A detector may include a camera, sound device, sensor, transducer, or other device that is responsive to a condition.

During operation, the drill bit 114 is rotated to drill the wellbore 118. The BHA 104 provides control of the drill bit 114 as it advances into the formation 102. Fluid or "mud" from a mud tank 120 is pumped downhole using a mud pump 122 powered by an adjacent power source, such as a prime mover or motor 124. The mud may be pumped from the mud tank 120, through a stand pipe 126, which feeds the mud into a mud bore (not shown) within the drillstring 106 and conveys the same to the drill bit 114. The mud exits one or more nozzles (not shown) arranged in the drill bit 114 and in the process cools the drill bit 114. After exiting the drill bit 114, the mud circulates back to the surface 110 via the annulus defined between the wellbore 118 and the drillstring 106, and in the process returns drill cuttings and debris to the surface. The cuttings and mud mixture are passed through line 128 and are processed such that a cleaned mud is returned down hole through the stand pipe 126 once again.

Still referring to FIG. 1, any LWD detectors 109 may be in communication with a computing device 140*a*, which is illustrated by way of example at the surface in FIG. 1 but may alternatively be located elsewhere, such as downhole, or a distributed computing system comprising multiple, spatially separated computing components (e.g. 140*a*, 140*b*, and or downhole). The hydraulic package(s) described herein may also be in communication with the computing device 140*a*. In some embodiments, one or more processor for controlling the hydraulic package(s) can be included or otherwise in communication with one or both of the LWD tool 108 and the computing device 140*a*. In FIG. 1, the computing device 140*a* is illustrated as being deployed in a work vehicle 142. However, a computing device to receive data from detectors 109, control the hydraulic package in LWD tool 108, and control drill bit 114 can be permanently installed with the surface equipment, be hand-held, or be remotely located. In some examples, the computing device 140*a* can process at least a portion of the data received and can transmit the processed or unprocessed data to another computing device 140*b* via a wired or wireless network 146. The other computing device 140*b* can be offsite, such as at a data-processing center. The other computing device 140*b* can receive the data, execute computer program instructions to issue commands to control the positioning of LWD tool 108, and communicate those commands to computing device 140*a*.

The computing devices 140*a-b* can be positioned belowground, aboveground, onsite, in a vehicle, offsite, etc. The computing devices 140*a-b* can include a processor interfaced with other hardware via a bus. A memory, which can include any suitable tangible (and non-transitory) computer-readable medium, such as RAM, ROM, EEPROM, or the like, can embody program components that configure operation of the computing devices 140*a-b*. In some aspects, the computing devices 140*a-b* can include input/output interface components (e.g., a display, printer, keyboard, touch-sensitive surface, and mouse) and additional storage.

The computing devices 140*a-b* can include communication devices 144*a-b*. The communication devices 144*a-b* can represent one or more of any components that facilitate a network connection. In the example shown in FIG. 1, the communication devices 144*a-b* are wireless and can include wireless interfaces such as IEEE 802.11, Bluetooth, or radio interfaces for accessing cellular telephone networks (e.g., RF stage/antenna for accessing a CDMA, GSM, UMTS, or other mobile communications network). In some examples, the communication devices 144*a-b* can use acoustic waves, surface waves, vibrations, optical waves, or induction (e.g., magnetic induction) for engaging in wireless communications. In other examples, the communication devices 144*a-b* can be wired and can include interfaces such as Ethernet, USB, IEEE 1394, or a fiber optic interface. The computing devices 140*a-b* can receive wired or wireless communications from one another and perform one or more tasks based on the communications.

Figure 2:
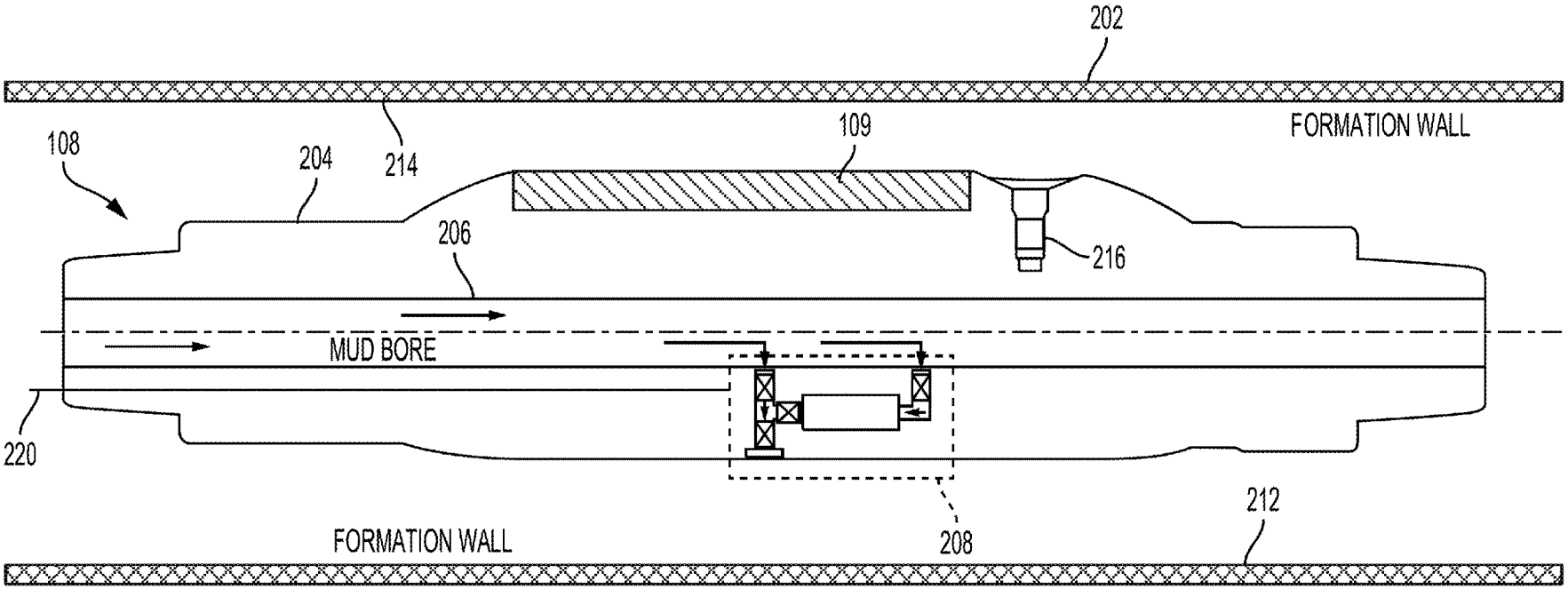
FIG. 2 is a cross-sectional, schematic, side view of a downhole tool according to some aspects.

FIG. 2 is a cross-sectional, schematic side view of a representative downhole tool 200 disposed in a wellbore 202 for discussing aspects of this disclosure. The downhole tool 200 may be implemented, for example, as part of the configuration of a nominal 8-inch size azimuthal lithodensity (ALD™) LWD tool. One exemplary feature of the downhole tool 108 is to provide measurements of formation density obtained from the wellbore 202. Downhole tool 108 includes, by way of example, a tool collar 204 and an internal, tubular housing 206 defining a mud bore within and optionally coaxial with the tool collar. The mud bore in downhole tool 108 is a fluid bore through which drilling mud passes when drilling. Downhole tool 200 also includes a hydraulic package 208, which diverts pressurized mud from the mud bore and may at times increase the pressure using an internal hydraulic pump. The hydraulic package may include at least one hydraulic valve such as valve 324, at least one flow line such as flow line 317, at least one hydraulic pump such as pump 315, all shown in FIG. 3, or any combination thereof. Pressurized mud is subsequently ejected out from the tool collar 204 through an orifice. The orifice is located at the opposite side of downhole tool 108 from a detector 109 (only partially visible) and provides direct thrust force against the formation wall portion 212 to push the downhole tool 108 towards formation wall 214 as necessary. Formation wall portions 212 and 214 are internal portions of the annulus of wellbore 202.

Still referring to FIG. 2, downhole tool 108 also includes a position sensor 216 in or on the tool collar 204. The position sensor 216 may be any of a variety of sensors responsive to a distance between the detector 109 (and the downhole tool itself) and formation wall portion 214, and to provide a signal indicative of the distance measured. For example, the position sensor can interpret the propagation or transmission of electromagnetic waves, light, radio waves, or sound waves downhole, which propagation or transmission depends in part on the distance. Thus, although the position sensor is responsive to distance, the control features described herein may be performed without necessarily obtaining an explicit distance value. Such a position sensor may be useful in more than one function of the downhole tool, so that the position sensor 216 used for generating a signal responsive to the distance as described herein may, in some embodiments, be or include a sensor used with other functions of the downhole tool 108. In some embodiments, the detector and position sensor can be the combined and the detector can serve as the position sensor. The visible portion of detector 109 in FIG. 2 is the detector blade. The detector in downhole tool 108 is a gamma ray density sensor.

Downhole tool 108 also includes connection 220, a connector for a cable running to a remotely located computer system such as computing device 140*a* of FIG. 1. The connection 220 to the hydraulic package 208 is used to control the hydraulic package 208, and also to provide the signal from position sensor 216 uphole to the remotely located computing device 140*a*. Downhole tool 108 can, as an addition to or as an alternative to being connected to a remote computing device, include a computing device such as a microcontroller, as described with respect to FIG. 3. The construction of a hydraulic package like hydraulic package 208 is discussed below with respect to FIG. 3, and the operation of such a hydraulic package is discussed below with respect to FIG. 5. Although downhole tool 108 is pictured in FIG. 2 as laying on its side in a horizontal wellbore, this orientation was chosen for illustrative convenience only. Such a downhole tool can be used in either a vertical or horizontal wellbore.

Figure 3:
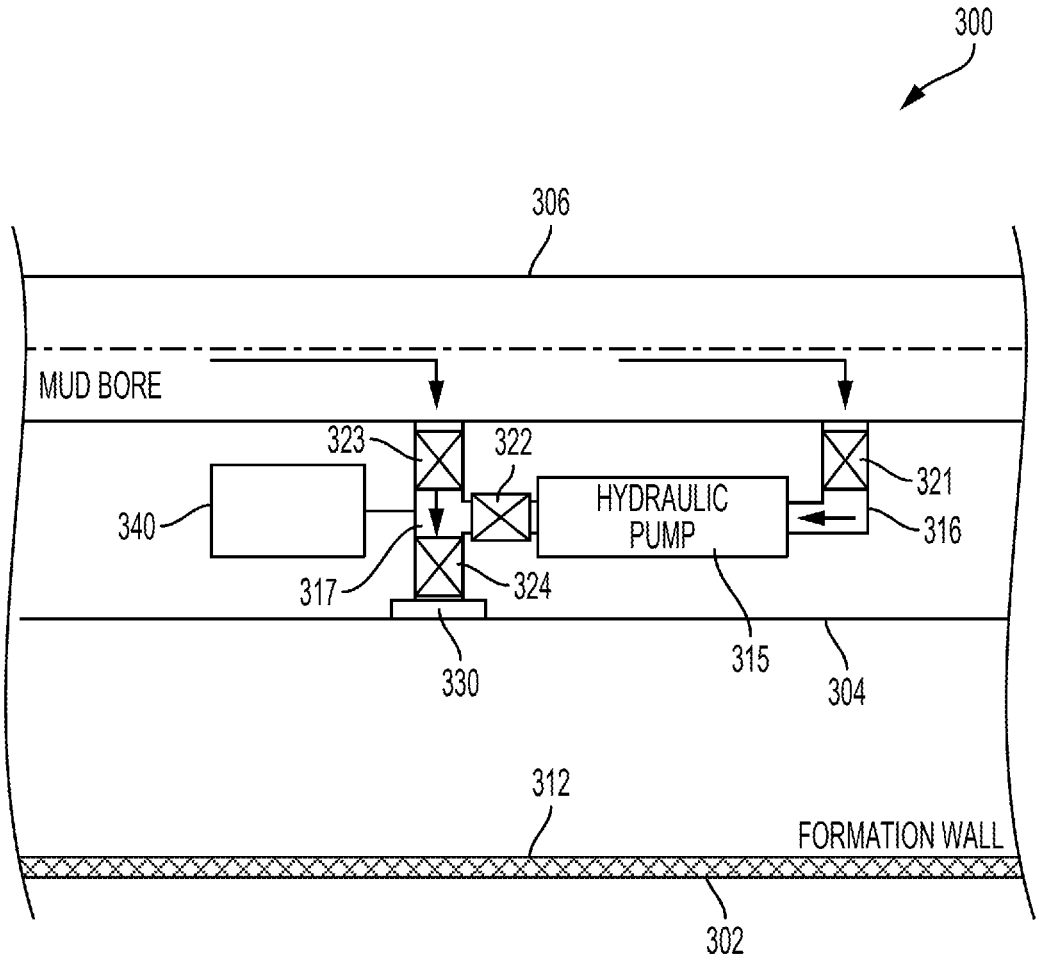
FIG. 3 is a cross-sectional, schematic view of the downhole tool of FIG. 2 enlarged to further detail the hydraulic package.

FIG. 3 is a cross-sectional, schematic view of a downhole tool 300 enlarged to further detail the hydraulic package. FIG. 3 shows a portion of an 8-inch azimuthal lithodensity (ALD™) LWD downhole tool 300 disposed in a wellbore 302. The downhole tool 300 provides measurements of formation density. Downhole tool 300 differs from downhole tool 200 of FIG. 2 in that it includes an on-board computing device as opposed to a connection for an external computing device. Downhole tool 300 includes a tool collar 304 and an internal, tubular housing 306 defining a mud bore within and coaxial with the tool collar 304. The mud bore in downhole tool 300 is a fluid bore through which drilling mud passes when drilling is taking place. The hydraulic package in FIG. 3 includes flow lines, valves and a hydraulic pump 315. These components are present and arranged in the same way as in hydraulic package 208 of the downhole tool 200 of FIG. 2. Flow lines 316 and 317 facilitate the flow of mud to be drawn into the hydraulic package. The first flow line 316 allows drilling mud to flow through hydraulic pump 315 for pressurizing the drilling mud while the second flow line 317 is used when the mud bore pressure is sufficiently high by itself. When first flow line 316 is activated, first valve 321, positioned at the fluid bore, and second valve 322 are open to allow mud to flow into hydraulic pump 315 and third valve 323, also positioned at the fluid bore, is closed to restrict mud flow to one direction. The hydraulic pump 315 can control and maintain the necessary pressure level to push against the formation wall portion 312 such that the reaction force (that acts on the tool collar 304) will push the tool collar 304 to the opposite side (detector blade side).

Still referring to FIG. 3, the downhole tool 300 includes a computing device 340, which includes a processor, typically a microcontroller. The inclusion of a processor in the downhole tool makes the positioning hardware and software substantially self-contained. Computing device 340 in this example is a relatively small controller board or card connected to each hydraulic component and the position sensor (not shown). The position sensor is located on the same side of the downhole tool as the detector (not shown), measures the standoff distance, and provides feedback to the computing device 340 for determining the hydraulic pressure required. In the event that the mud bore pressure is sufficient to provide the thrust force, the first flow line 316 will be shut off by closing valves 321 and 322, and only the second flow line 317 will be open by opening the valves 323 and 324. The first flow line is connected between the first valve 321 and the second valve 322, the hydraulic pump 315 is connected in the first flow line 316, and the second flow line 317 is connected between the third hydraulic valve 323 and the fourth valve 324. The fourth valve 324 is positioned at orifice 330, which ejects the mud as necessary as the second flow line is selectively connected to the first flow line by the second valve 322. The use of the designators "first," "second," etc. is for convenience within the descriptions herein and is not intended to serve as a limitation.

Hydraulic valves 321, 322, 323 and 324 as discussed above include a non-return function to prevent backflow of pressure. The hydraulic pump and the hydraulic valves can also include an auto adjust function that uses feedback signals from the position sensor shown in FIG. 2 or from other sensors in the downhole tool. In some embodiments, computing devices 140*a* and 340 can include the computer program code and connections for the logging operation or any other functions being carried out by the downhole tool. Through use of the programmed processor in the computing device, the downhole tool can be positioned to maintain any range of distance desired from the formation wall. In the case of some tools, the detector should be kept as close to the formation wall as possible. For example, a gamma ray density sensor as discussed above generally needs to be as close as possible to touching the formation to obtain accurate readings, and this distance must be maintained as the downhole tool moves and irregularities in the formation wall are traversed. In this type of downhole tool, the computing device keeps the detector at a distance that is less than a maximum permitted stand-off distance. However, some downhole tools may work best if the distance from the formation wall is within an optimum range, in which case the distance value would be maintained at a value within a range defined by a maximum and minimum standoff distance. These distances can be fixed and set within computer program code or can be provided through user input by an operator.

Figure 4:
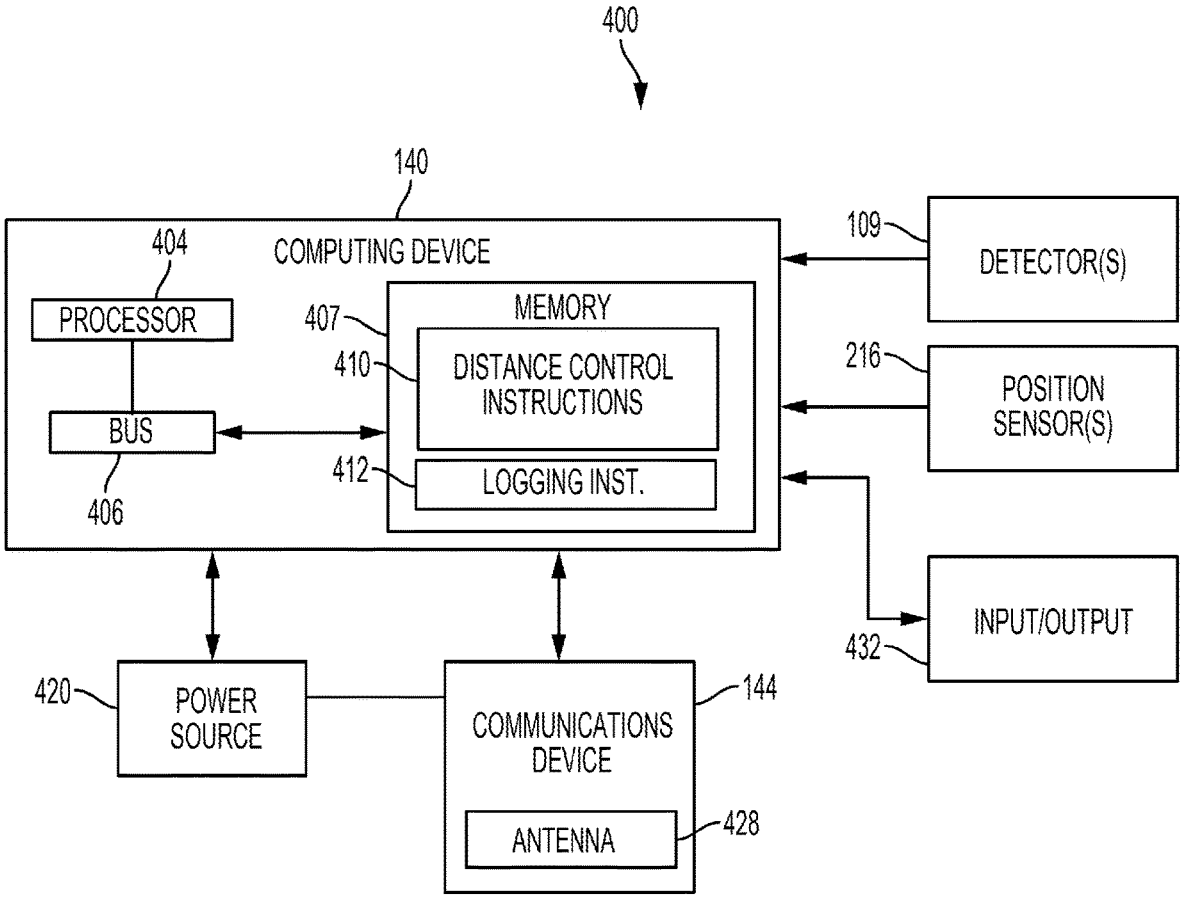
FIG. 4 is a block diagram of a computing system for controlling the hydraulic package in a downhole tool according to some embodiments.

FIG. 4 is a block diagram of an example of a system 400 for controlling the hydraulic package in a downhole tool according to some embodiments. In some examples, the components shown in FIG. 4 (e.g., the computing device 140, power source 420, and communications device 144) can be integrated into a single structure. For example, the components can be within a single housing. In other examples, the components shown in FIG. 4 can be distributed (e.g., in separate housings) and in electrical communication with each other. In the example of FIG. 4, the computing device 140 also includes logging functions for a logging-while-drilling tool. It should be noted that computing device 340 of FIG. 3 has the same basic architecture as computing device 140 shown here, including the processor, memory, and bus.

The system 400 includes a computing device 140. The computing device 140 can include a processor 404, a memory 407, and a bus 406. The processor 404 can execute one or more operations for obtaining data associated with the wellbore. The processor 404 can execute instructions stored in the memory 407 to perform the operations. The processor 404 can include one processing device or multiple processing devices. Non-limiting examples of the processor 404 include a Field-Programmable Gate Array ("FPGA"), an application-specific integrated circuit ("ASIC"), a microprocessor, etc. In computing device 340 of FIG. 3, processor 404 is a microcontroller or embedded controller.

The processor 404 can be communicatively coupled to the memory 407 via the bus 406. The non-volatile memory 407 may include any type of memory device that retains stored information when powered off. Non-limiting examples of the memory 407 include electrically erasable and programmable read-only memory ("EEPROM"), flash memory, or any other type of non-volatile memory. In some examples, at least part of the memory 407 can include a medium from which the processor 404 can read instructions. A computer-readable medium can include electronic, optical, magnetic, or other storage devices capable of providing the processor 404 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc. In some examples, the memory 407 can include computer program instructions for executing positioning control functions described herein, referred to in FIG. 4 as distance control instructions 410. In some examples, the memory 407 can include logging instructions 412. The memory can also store distance values (not shown) for reference by the distance control instructions 410 and logging data (not shown).

The system 400 can include a power source 420. The power source 420 can be in electrical communication with the computing device 140 and the communications device 144. In some examples, the power source 420 can include a battery or an electrical cable (e.g., a wireline). In some examples, the power source 420 can include an AC signal generator. The computing device 140 can operate the power source 420 to apply a transmission signal to the antenna 428. For example, the computing device 140 can cause the power source 420 to apply a voltage with a frequency within a specific frequency range to the antenna 428. This can cause the antenna 428 to generate a wireless transmission. In other examples, the computing device 140, rather than the power source 420, can apply the transmission signal to the antenna 428 for generating the wireless transmission.

The system 400 can also include the communications device 144. The communications device 144 can include or can be coupled to the antenna 428. In some examples, part of the communications device 144 can be implemented in software. For example, the communications device 144 can include instructions stored in memory 407. The communications device 144 can receive signals from remote devices and transmit data to remote devices (e.g., the computing device 140*b* of FIG. 1). For example, the communications device 144 can transmit wireless communications that are modulated by data via the antenna 428. In some examples, the communications device 144 can receive signals (e.g., associated with data to be transmitted) from the processor 404 and amplify, filter, modulate, frequency shift, and otherwise manipulate the signals. In some examples, the communications device 144 can transmit the manipulated signals to the antenna 428. The antenna 428 can receive the manipulated signals and responsively generate wireless communications that carry the data.

The system 400 can receive input from detector(s) 109 as shown in FIG. 1 and position sensors 216 as shown in FIG. 2. System 400 in this example also includes input/output interface 432. Input/output interface 432 can connect to a keyboard, pointing device, display, and other computer input/output devices. An operator may provide input using the input/output interface 432. Such input may include distance parameters defining the optimal distance to be maintained by the hydraulic package in the downhole tool.

Figure 5:
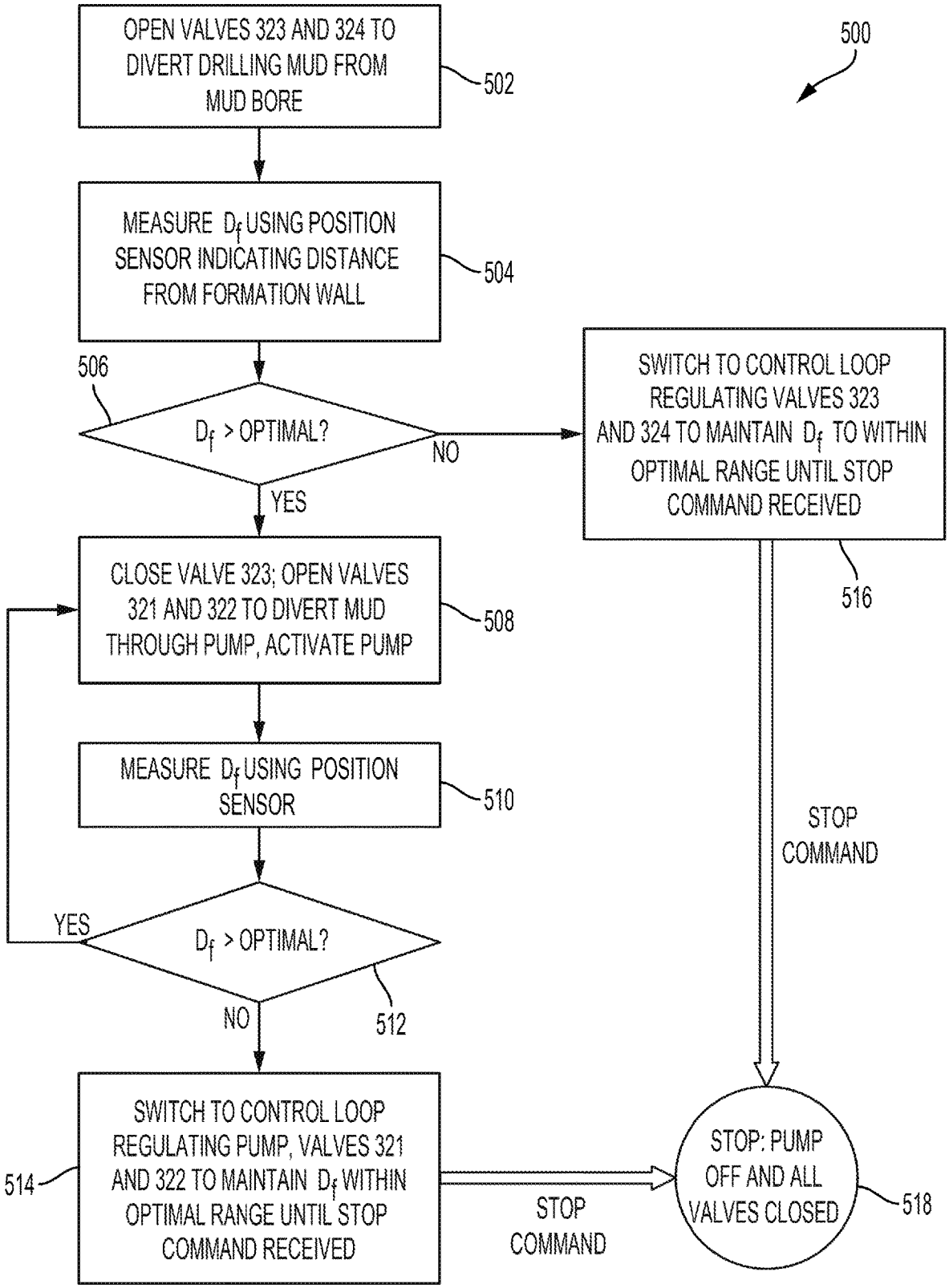
FIG. 5 is a flowchart that illustrates a method of operation of the hydraulic package of a downhole tool according to some aspects.

FIG. 5 is a flowchart of an example process for providing real-time, automated control of the position of the downhole tool relative to a formation face. Some examples can include more, fewer, or different blocks than those shown in FIG. 5. The processing of the various blocks can take place simultaneously or in an order different than that shown in FIG. 5. The blocks shown in FIG. 5 can be implemented using, for example, one or more of the computing devices 140*a-b* shown in FIG. 1 and FIG. 4, the computing device shown in FIG. 3, some other microprocessor connected to the hydraulic package, or a combination of any or all of these.

Process 500 of FIG. 5 begins with block 502. At block 502, flow line 317 is opened between the fluid bore within the downhole tool and the orifice in the tool collar to allow fluid pressure within the wellbore to force fluid through the orifice. A flow line such as flow line 317 of FIG. 3 is opened by opening third and fourth valves 323 and 324 to divert drilling mud from the mud bore to allow fluid pressure from with the mud bore to force fluid through the orifice. At block 504 an initial value of the distance of the downhole tool from the formation wall, $D_f$, is measured using the position sensor of the downhole tool, for example, position sensor 216 of FIG. 2. At block 506, a determination is made by the computing device as to whether distance $D_f$ is greater than a selected value for the optimal range. If the distance is greater, the fluid pressure from the mud bore is insufficient to maintain the downhole tool close enough to the formation wall. In this case, third hydraulic valve 323 is closed and first and second valves 321 and 322 are opened at block 508 to divert drilling mud through the hydraulic pump between the fluid bore and the orifice. The pump continues to be activated as needed and the distance continues to be measured at block 510 until the distance is no longer greater than the selected optimal range at block 512. While the distance is within the optimal range, the processor executes a control loop at block 514 regulating the hydraulic pump 315, and first and second valves 321 and 322 to maintain the distance between the formation wall and the downhole tool within the selected optimal range until a "stop" command is received.

Still referring to FIG. 5, if the initial distance is within or below the selected optimal range at block 506, the fluid pressure from the mud bore is sufficient, and the processor executes a control loop at block 516 regulating the third and fourth valves 323 and 324 connected to flow line 317 to maintain the distance between the formation wall and the detector within the selected optimal range until a stop command is received. With either control loop, all valves are closed at block 518 when the stop command is received. Although the process, computing devices, and hydraulic package described above are shown by way of example as positioning a downhole tool with a detector, the same process and components can be used to position any downhole tool.

Figure 6:
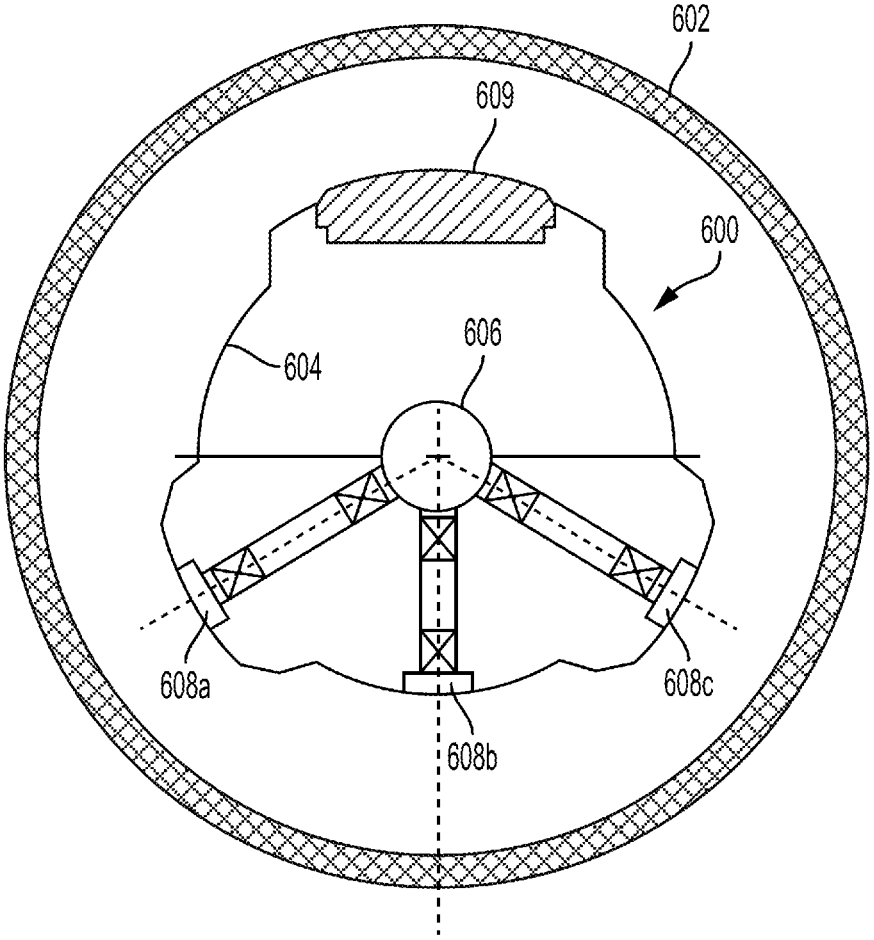
FIG. 6 is a cross-sectional, schematic, top view of a downhole tool according to additional aspects.

FIG. 6 is a cross-sectional, schematic, top view of a downhole tool according to additional aspects. FIG. 6 shows multiple orifices and hydraulic packages spaced out angularly to provide forces from different directions so that the position and contact of a detector relative to the formation wall can be further optimized. Each hydraulic package includes at least one hydraulic valve and can include a hydraulic pump, additional hydraulic valves, and one or more flow lines. Downhole tool 600 is shown in wellbore 602. Downhole tool 600 includes tool collar 604 and internal, tubular housing 606 defining a fluid bore. Downhole tool 600 includes multiple hydraulic packages, in this example, three hydraulic packages, 608*a*, 608*b*, and 608*c*, angularly distributed about the tool collar. Each hydraulic package is processor controlled in the manner discussed above. With multiple, angularly distributed hydraulic packages, the positioning of detector 609 relative to the formation wall can be more precisely controlled.

In some aspects, systems, devices, and methods for hydraulic positioning are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1

A downhole tool includes a housing defining a fluid bore, a sensor responsive to a distance between the downhole tool and a formation wall of an annulus of a wellbore and provide a signal indicative of the distance, and a hydraulic valve controllable by a processor connectable to the sensor, the hydraulic package operable to position or position the downhole tool by selectively diverting fluid from the fluid bore to the annulus based on the signal from the sensor.

Example 2

The downhole tool of example 1 further includes the processor connected to the sensor to control the hydraulic valve.

Example 3

The downhole tool of examples 1 or 2 wherein the hydraulic valve further includes a plurality of hydraulic valves angularly distributed around the downhole tool.

Example 4

The downhole tool of examples 1-3 further includes a detector to make measurements, observations, or both, of or within the formation wall.

Example 5

The downhole tool of examples 1-4 wherein the detector includes a gamma ray density sensor.

Example 6

The downhole tool of examples 1-5 further including a hydraulic pump connected between the fluid bore and an orifice.

Example 7

The downhole tool of examples 1-6 wherein the hydraulic valve includes multiple valves and the hydraulic tool includes a first flow line connected between a first valve and a second valve, wherein the first valve is positioned at the fluid bore. The hydraulic package also includes a hydraulic pump connected in the first flow line and a second flow line connected between a third valve and a fourth valve, wherein the third valve is positioned at the fluid bore and the fourth valve is positioned at an orifice, and wherein the second flow line is also selectively connected to the first flow line by the second valve.

Example 8

The downhole tool of examples 1-7 further includes a connection for a computing system to be located remotely from the downhole tool, the computing system including the processor.

Example 9

The downhole tool of examples 1-8 further comprising a logging-while-drilling tool.

Example 10

A logging-while-drilling tool includes a tool collar including an orifice, a tubular housing defining a fluid bore within and coaxial with the tool collar, a detector within or on the tool collar opposite the orifice, a sensor responsive to a distance between the detector and a formation wall of an annulus of a wellbore and provide a signal indicative of the distance, and a hydraulic valve controllable by a processor using the signal from the sensor. The hydraulic valve in this example is operable to maintain a specified value for the distance by selectively diverting fluid from the fluid bore to the orifice based on the signal from the sensor.

Example 11

The logging-while-drilling tool of example 10 further includes the processor connected to the sensor to control the hydraulic valve.

Example 12

The logging-while-drilling tool of examples 10 or 11 wherein the hydraulic valve further includes a plurality of hydraulic valves angularly distributed around the tool collar.

Example 13

The logging-while-drilling tool of examples 10-12 wherein the specified value for the distance includes any value less than a maximum distance.

Example 14

The logging-while-drilling tool of examples 10-13 wherein the detector includes a gamma ray density sensor.

Example 15

The logging-while-drilling tool of examples 10-14 including a first flow line connected between a first valve and a second valve, wherein the first valve is positioned at the fluid bore, a hydraulic pump connected in the first flow line, and a second flow line connected between a third valve and a fourth valve. In this example, the third valve is positioned at the fluid bore and the fourth valve is positioned at the orifice, and the second flow line also selectively connected to the first flow line by the second valve.

Example 16

The logging-while-drilling tool of examples 10-15 further including a connection for a computing system to be located remotely from the logging-while-drilling tool, the computing system further including the processor.

Example 17

A method of positioning a downhole tool, wherein the method includes opening, by a processor, a flow line between a fluid bore within the downhole tool and an orifice in a collar of the downhole tool to allow fluid pressure within the fluid bore to force fluid through the orifice, measuring, using a position sensor, an initial distance between the downhole tool and a formation wall of an annulus of a wellbore, routing, using the processor, the fluid through a hydraulic pump between the fluid bore and the orifice while the initial distance is greater than a selected range, and controlling, using the processor, the hydraulic pump to maintain an operating distance between the formation wall and the downhole tool within the selected range; and controlling, using the processor and while the initial distance is within or below the selected range, at least one valve connected to the flow line to maintain the operating distance between the formation wall and the downhole tool within the selected range using the fluid pressure.

Example 18

The method of example 17 wherein the hydraulic pump includes a plurality of hydraulic pumps, each angularly distributed about the collar.

Example 19

The method of examples 17 or 18 wherein the routing of the fluid through the hydraulic pump comprises opening a first hydraulic valve and a second hydraulic valve, wherein the at least one valve comprises a third hydraulic valve and a fourth hydraulic valve, and wherein the opening of the flow line comprises opening the third hydraulic valve and the fourth hydraulic valve.

Example 20

The method of examples 17-19 wherein the downhole tool includes a detector opposite the orifice.

Example 21

The method of examples 17-20 wherein the selected range includes any value less than a maximum distance.

Example 22

The method of examples 17-21 wherein the downhole tool is a logging-while-drilling tool.

Example 23

The downhole tool of examples 1-9 wherein the downhole tool is a logging-while-drilling tool further including a detector to make measurements, observations, or both, of or within the formation wall.

Example 24

The downhole tool of example 23 wherein the detector includes a gamma ray density sensor.

Example 25

The downhole tool of examples 23 or 24 wherein the hydraulic package includes a hydraulic pump connected between the fluid bore and an orifice, and at least one hydraulic valve connected to the hydraulic pump.

Example 26

The downhole tool of examples 23-25 wherein the hydraulic package includes a first flow line connected between a first hydraulic valve and a second hydraulic valve, wherein the first hydraulic valve is positioned at the fluid bore; a hydraulic pump connected in the first flow line, and a second flow line connected between a third hydraulic valve and a fourth hydraulic valve, wherein the third hydraulic valve is positioned at the fluid bore and the fourth hydraulic valve is positioned at an orifice, and wherein the second flow line is also selectively connected to the first flow line by the second hydraulic valve.

Example 27

The downhole tool of examples 23-26 further includes a connection for a computing system to be located remotely from the downhole tool, wherein the computing system includes the processor.

Example 28

The downhole tool of examples 24-27 further includes a logging-while-drilling tool.

Example 29

The downhole tool of examples 23-28 further includes a connection for a computing system to be located remotely from the downhole tool, the computing system further comprising the processor.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A downhole tool comprising:

a housing defining a fluid bore;

a collar including an orifice;

a sensor responsive to a distance between the downhole tool and a formation wall of an annulus of a wellbore to provide a signal indicative of the distance; and a hydraulic valve controllable by a processor connectable to the sensor, the hydraulic valve positionable to selectively divert fluid from the fluid bore through the orifice to the annulus based on the signal from the sensor to provide thrust force against the formation wall to position the sensor of the downhole tool within a selected distance range from the formation wall.

2. The downhole tool of claim 1 further comprising the processor connected to the sensor to control the hydraulic valve.

3. The downhole tool of claim 1 wherein the hydraulic valve further comprises a plurality of hydraulic valves angularly distributed around the downhole tool.

4. The downhole tool of claim 1 further comprising a detector to make measurements, observations, or both, of or within the formation wall.

5. The downhole tool of claim 4 wherein the detector comprises a gamma ray density sensor.

6. The downhole tool of claim 1 further comprising a hydraulic pump connected to the hydraulic valve between the fluid bore and the orifice.

7. The downhole tool of claim 1 wherein the hydraulic valve further comprises a first valve, a second valve, a third valve, and a fourth valve, and the downhole tool further comprises:

a first flow line connected between the first valve and the second valve, wherein the first valve is positioned at the fluid bore;

a hydraulic pump connected in the first flow line; and a second flow line connected between the third valve and the fourth valve, wherein the third valve is positioned at the fluid bore and the fourth valve is positioned at the orifice, the second flow line also selectively connected to the first flow line by the second valve.

8. The downhole tool of claim 1 further comprising a connection for a computing system to be located remotely from the downhole tool, the computing system including the processor.

9. The downhole tool of claim 1 further comprising a logging-while-drilling tool.

10. A logging-while-drilling tool comprising:

a tool collar including an orifice;

a tubular housing defining a fluid bore within and coaxial with the tool collar;

a detector within or on the tool collar opposite the orifice;

a sensor within or on the tool collar responsive to a distance between the detector and a formation wall and provide a signal indicative of the distance; and a hydraulic valve controllable by a processor connectable to the sensor, the hydraulic valve positionable to maintain a specified value for the distance by selectively diverting fluid from the fluid bore to the orifice to provide thrust force against the formation wall to position the sensor of the logging-while-drilling tool within a selected distance range from the formation wall based on the signal from the sensor.

11. The logging-while-drilling tool of claim 10 further comprising the processor connected to the sensor to control the hydraulic valve.

12. The logging-while-drilling tool of claim 10 wherein the hydraulic valve further comprises a plurality of hydraulic valves angularly distributed around the tool collar.

13. The logging-while-drilling tool of claim 10 wherein the specified value for the distance comprises any value less than a maximum distance.

14. The logging-while-drilling tool of claim 10 wherein the detector comprises a gamma ray density sensor.

15. The logging-while-drilling tool of claim 10 wherein the hydraulic valve further comprises a first valve, a second valve, a third valve, and a fourth valve, and the logging-while-drilling tool further comprises:

a first flow line connected between the first valve and the second valve, wherein the first valve is positioned at the fluid bore;

a hydraulic pump connected in the first flow line; and a second flow line connected between the third valve and the fourth valve, wherein the third valve is positioned at the fluid bore and the fourth valve is positioned at the orifice, the second flow line also selectively connected to the first flow line by the second valve.

16. The logging-while-drilling tool of claim 10 further comprising a connection for a computing system to be located remotely from the logging-while-drilling tool, the computing system further comprising the processor.

17. A method of positioning a downhole tool, the method comprising:

opening, by a processor, a flow line between a fluid bore within the downhole tool and an orifice in a collar of the downhole tool to allow fluid pressure within the fluid bore to force fluid through the orifice and provide thrust force against a formation wall of an annulus of a wellbore to position a sensor of the downhole tool within a selected distance range from the formation wall;

measuring, using the sensor, an initial distance between the downhole tool and the formation wall;

routing, using the processor, the fluid through a hydraulic pump between the fluid bore and the orifice while the initial distance is greater than the selected distance range;

controlling, using the processor, the hydraulic pump to maintain an operating distance between the formation wall and the downhole tool within the selected distance range; and controlling, using the processor and while the initial distance is within or below the selected distance range, at least one valve connected to the flow line to maintain the operating distance between the formation wall and the downhole tool within the selected distance range using the fluid pressure.

18. The method of claim 17 wherein the thrust force is angularly distributed about the collar.

19. The method of claim 17 wherein:

the routing of the fluid through the hydraulic pump comprises opening a first hydraulic valve and a second hydraulic valve;

the at least one valve comprises a third hydraulic valve and a fourth hydraulic valve; and the opening of the flow line comprises opening the third hydraulic valve and the fourth hydraulic valve.

20. The method of claim 17 wherein the downhole tool comprises a detector opposite the orifice.

* * * * *